US006772616B2

(12) United States Patent
Cunningham et al.

(10) Patent No.: US 6,772,616 B2
(45) Date of Patent: Aug. 10, 2004

(54) FORMING MACHINE FOR SHEETS OF FORMABLE MATERIAL

(75) Inventors: David H. Cunningham, Fort Lupton, CO (US); Bruce E. Meyer, Arvada, CO (US)

(73) Assignee: New Tech Machinery, Denver, CO (US)

( * ) Notice: Subject to any disclaimer, the term of this patent is extended or adjusted under 35 U.S.C. 154(b) by 0 days.

(21) Appl. No.: 10/328,401

(22) Filed: Dec. 23, 2002

(65) Prior Publication Data

US 2003/0094027 A1 May 22, 2003

Related U.S. Application Data

(63) Continuation of application No. 09/783,247, filed on Feb. 13, 2001, now abandoned.

(51) Int. Cl.[7] ..... B21D 5/14
(52) U.S. Cl. ..... 72/181
(58) Field of Search ..... 72/181, 182, 179

(56) References Cited

U.S. PATENT DOCUMENTS 1,673,787 A * 6/1928 Frahm ..... 72/181
3,748,884 A * 7/1973 Colbath ..... 72/181
3,886,779 A * 6/1975 McClain ..... 72/181
3,903,723 A * 9/1975 Colbath ..... 72/181
3,914,971 A * 10/1975 Colbath ..... 72/181
4,716,754 A * 1/1988 Youngs ..... 72/181
4,947,671 A * 8/1990 Lindstrom ..... 72/181
5,394,722 A * 3/1995 Meyer ..... 72/181
5,740,687 A * 4/1998 Meyer et al. ..... 72/181
5,787,748 A * 8/1998 Knudson et al. ..... 72/181

* cited by examiner

*Primary Examiner*—Daniel C. Crane
(74) *Attorney, Agent, or Firm*—Timothy J. Martin; Michael R. Henson; Rebecca A. Gegick

(57) ABSTRACT

A forming machine receives an elongated sheet of formable material to form a desired profile has a rigid framework supporting a sheet drive that includes a plurality of pairs of co-acting rollers to advance the sheet through the framework from an upstream entrance to a downstream exit. A drive assembly interconnects at least one roller in each of the pairs to rotatably drive the roller and advance the sheet in the downstream direction. Each of a plurality of carriage rails extends transversely along the framework and has first and second carriage mounts slideably disposed thereon. First and second tool rails are secured, respectively, to each of the first and second carriage mounts permitting the tooling rails to move laterally within the framework. Each tooling rail supports a plurality of forming elements defining at least two forming stations to bend the sheet as desired while it advances through the framework.

22 Claims, 8 Drawing Sheets

FORMING MACHINE FOR SHEETS OF FORMABLE MATERIAL

RELATED APPLICATION

This application is continuation of application Ser. No. 09/783,247 filed Feb. 13, 2001, now abandoned.

FIELD OF THE INVENTION

The present invention generally relates to material fabricating machines, but more particularly relates to forming machines wherein an elongated strip of material is advanced through the machine against forming elements in order to progressively shape the strip of material into a desired cross-sectional configuration. Specifically, the present invention concerns metal forming apparatus that receives an elongate strip of material, either as a panel or from a continuous spool, to fabricate a shaped member for the construction industry. This invention is particularly concerned with a machine that is adjustable to alter profile dimensions on a strip of material as well as a machine that can be easily custom configured for different profiles.

BACKGROUND OF THE INVENTION

Material forming machines play a significant role in modern industry and include, for example, machines which stamp, roll, form, cut and extrude metal, to name a few. One type of machine, and a type to which the present invention is directed, receives an elongated strip of material at an entry way, advances the strip of material progressively through the machine and against laterally positioned forming elements to configure longitudinal margins of the strip into desired useful cross-sections. After formation, the strip is discharged at an exit location, and a shear may be positioned at the exit in order to cut the formed material into selected lengths. The strips of material that are fed into the machine may either be fed as discrete lengths or, as is more typically the case, a continuous feed is provided from a coil, such as a coil of metal to be formed, and the formed strip is cut into usable lengths at the exit location or in the machine. Specific examples of such machines for which the present invention is particularly useful include, roof panel and siding panel forming machines.

Existing material forming machines typically have a framework which supports a drive assembly for advancing the elongated strip of material from the entrance to the exit. The drive assembly is coupled to one or more pairs of co-acting rollers centrally located along the pathway of the strip. It has long been thought necessary that the co-acting pairs include two driven rollers each journaled for synchronous rotation about first and second axes, respectively, which rollers were located above and below the strip as it passed through the frame work. However, as set forth in U.S. Pat. No. 5,740,687 issued Apr. 21, 1998 to Meyer et al and assigned to the assignee of the present invention, a forming apparatus was disclosed wherein the pairs of co-acting rollers each comprise a driven roller connected to the drive assembly and a free wheeling roller that was adjustably mounted relative to its associated driven roller.

In any event, in material forming machines, it is known to provide a plurality of forming rollers that are disposed along the pathway of the strip to configure one or both margins into a desired profile. This is accomplished by progressively bending the margins into a particular shape. Sometimes these forming rollers are each independently mounted to the framework at selected locations, but in other technique involves a group of forming elements together in forming station sets along the pathway of the strip. For example, in U.S. Pat. No. 5,425,259 issued Jun. 20, 1995 to Coben et al discloses a forming machine for bending strips wherein an elongated rail structure is secured within the interior of the framework of the machine and is removable out of one entrance or exit of the frame work. The rail structure was mounted at discrete mounting locations spaced laterally of the drive mechanism, and a plurality of forming elements were disposed on the rail structure to define at least two longitudinally spaced forming stations. The rail structure was removable from the framework without detaching the mounting stations. Alternative sets of rail structures were then interchangeably mounted in the framework as forming sets to allow formation of different profiles without individually changing each forming station.

While all of these existing machines are quite useful and effective in fabricating metal strips into shaped members, such as panels and gutters, many machines can only form a single profile so that the fabricator must acquire separate machines for each profile desired to be configured or each change of dimensions. Alternatively, the entire set of forming elements need to be replaced by individually detaching each forming element or, in certain cases, by replacing a forming station box comprising a set of forming rollers. In U.S. Pat. No. 5,394,722 issued Mar. 7, 1995 to Meyer, apparatus for forming profiles on strip materials is disclosed wherein a standard profile can be formed of two different sizes or physical dimensions. The machine shown in the '722 patent utilizes rollers that may position toward and apart from one another for selected spacing between two relative positions thereby to selectively vary the profile formed.

Nonetheless, there remains a need for material forming machines of improved design wherein greater flexibility of fabrication may be achieved. There is a need for machines that are easily adjustable to vary the profile dimensions including such dimensions as profile height and profile separation with a minimum of down time for the machine. There is a further need for machines which can easily be customized for different profiles. The present invention is directed toward satisfying such needs.

SUMMARY OF THE INVENTION

It is an object of the present invention to provide a new and useful material forming machine that is operative to form elongated strips of material, such as metal, into desired cross-sectional profiles as the strip of material is advanced through the machine.

Another object of the present invention is to provide a forming machine that can form cross-sectional profiles that may be easily varied in shape and dimensions.

A further object of the present invention is to provide a material forming machine wherein forming rollers may be interchanged as sets without the need to mount and demount each individual forming roller set independently from one another.

Still a further object of the present invention is to provide a material forming machine for strips of material, such as metal, of simplified construction with enhanced ease of adjustability for the profiles on the strips formed thereby.

It is still a further object of the present invention to provide a material forming machine that is compact in size yet versatile in use.

Yet another object of the present invention is to provide a material forming machine that is capable of providing a wide variety of profiles while being readily transportable.

According to the present invention, then, a forming machine is adapted to receive an elongated sheet of formable material and is operative to form a desired profile on that sheet. The forming machine includes a rigid framework that has side frames rigidly interconnected to one another by transverse members to form a rigid cage having an interior and a width between the side frames. The cage extends about a forming region through which the elongated sheet may be advanced from an upstream entrance to a downstream exit. A sheet drive is supported by the framework and is operative to advance the elongated sheet therethrough. The sheet drive includes a plurality of pairs of co-acting rollers with each of the pairs of rollers being longitudinally spaced from an adjacent pair in the downstream direction from the entrance to the exit. A drive assembly is then interconnected to at least one roller in each of the pairs of co-acting rollers. The drive assembly operates to rotatably drive such roller whereby each of the pairs of co-acting rollers is operative to engage a portion of the elongated sheet and advance the elongated sheet in a downstream direction through said framework and thereafter discharge the elongated sheet after forming the profiles thereon at the exit of the frame work. Preferably, each of the pairs of co-acting rollers includes a driven roller and a free wheeling roller. The free wheeling roller is rotatably supported by an upper transverse member. Rotation of the driven roller imparts an equal counter rotation to its associated free wheeling roller.

A plurality of pairs of carriage rails are supported by the framework and extend transversely thereof. Each of the carriage rails has opposite ends secured to the framework at a location proximately to a respective side frame so as to extend a majority of the width of the frame work. First and second carriage mounts are then slideably disposed on each of the carriages. A first tooling rail is secured in a mounted state to the first carriage mount on each said pair of carriage rails and a second tooling rail is secured in a mounted state to the second carriage mounts on each said pair of carriage rails whereby the tooling rails may be moved laterally within the cage defined by the frame work. A plurality of forming elements is then supported by each tooling rail to define at least two forming stations with the forming stations located in a longitudinally spaced relation to one another along the tooling rail. These forming stations are positioned to receive an edge portion of the elongated sheet when in the mounted state whereby the forming stations are operative to bend the elongated sheet into the desired profile as the elongated sheet is advanced through the forming region by the drive assembly.

A plurality of pairs of opposed primary rail mounts are secured to the framework in parallel spaced-apart relation to one another. One primary rail mount on each pair extends alongside one of the side frame while the other primary rail mount of each pair extends alongside the other of the side frames. The primary rail mounts of each pair preferably extend longitudinally between respective ones of the lower transverse members which thereby define lower pairs to support the opposed primary rail mounts. A first intermediate tooling rail mount may be secured in an affixed state between the first carriage mounts on each pair of carriage rails and a second intermediate tooling rail mount may be secured in an affixed state between a second carriage mount on each pair of carriage rails. With this configuration, each tooling rail is removably secured to respective intermediate tooling rail mount. Moreover, the tooling rails are movable laterally and independently of one another in the interior of the cage by sliding the respective carriage mounts to and fro on the carriage rails. The carriage rails may have index markings to correspond to selected positions for the carriage mounts whereby the carriage mounts may be registered with the index markings to determine the dimensions of the profile to be formed. One or more movable limit stop members in the form of locking collars may be disposed on each carriage rail. Here, the limit stop member is adjustably positionable along its respective carriage rail and operates in a secured state to restrict movement of a respective carriage rail mount in at least one lateral direction.

The carriage rail mounts preferably include a body portion that has a bore extending therethrough. A mounting head is supported on the body portion and acts to mount the intermediate tooling rail mount and tooling rail. The body portion includes slots formed therein that intersect the bore and each other thereby to form a clamping arm that is integral with the body. The clamping arm is operative to extend around a perspective rail. Each clamping arm has an associated fastener operative to selectively clamp the respective carriage mount at a selected location along the respective carriage rail.

These and other objects of the present invention will become more readily appreciated and understood from a consideration of the following detailed description of the exemplary embodiment of the present invention when taken together with the accompanying drawings, in which:

Figure 12:
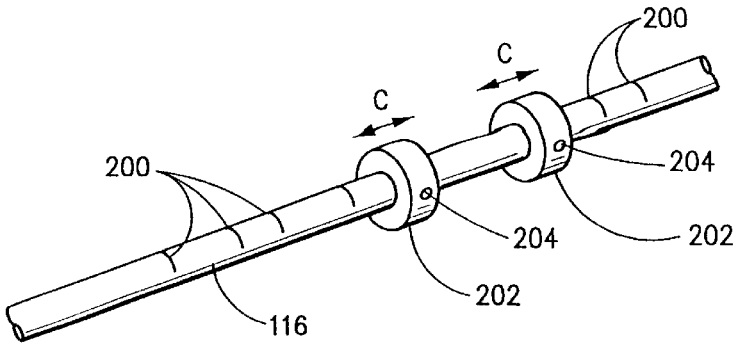
Figure 13:
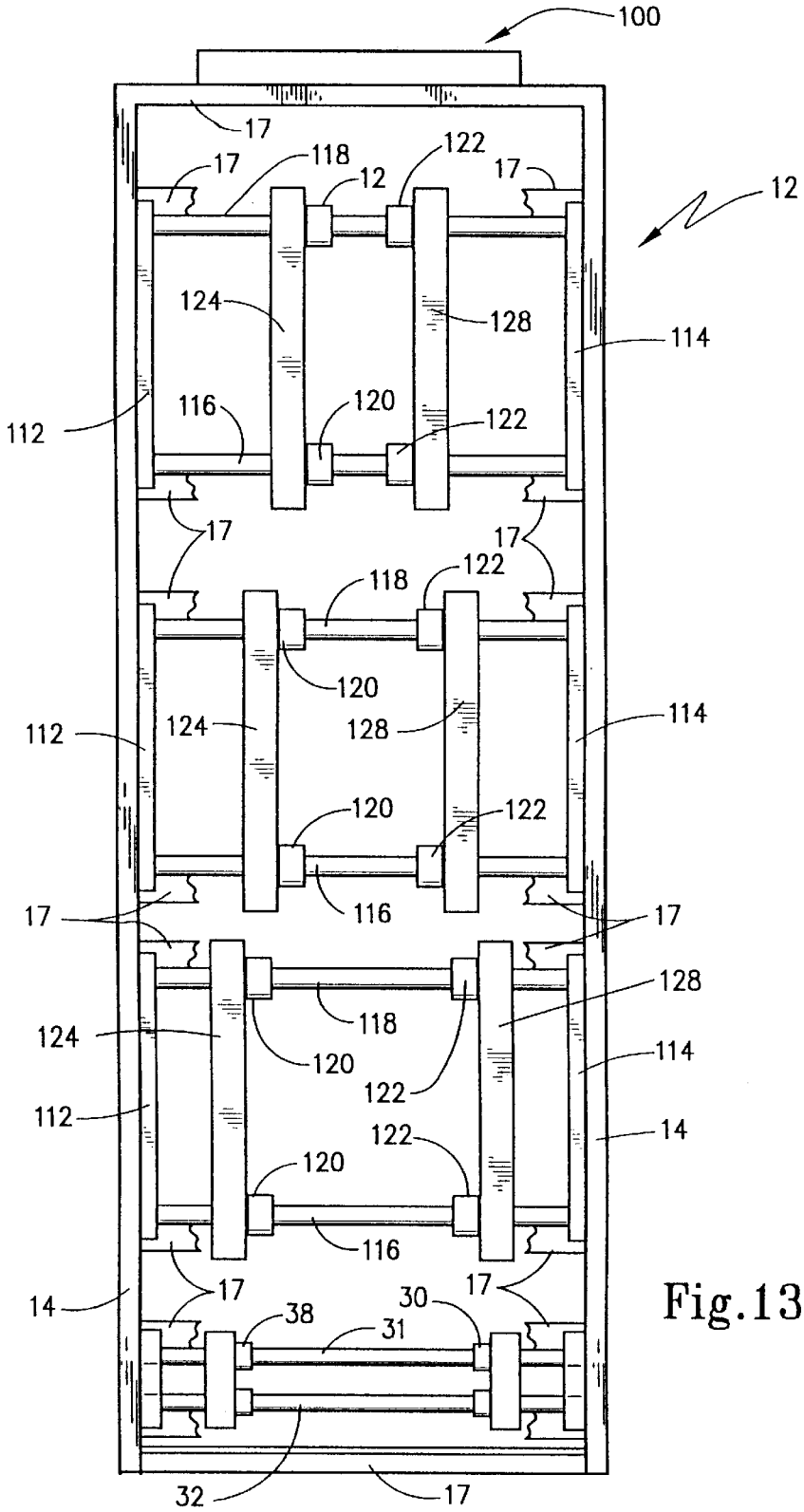
Figures 14A, 14B:
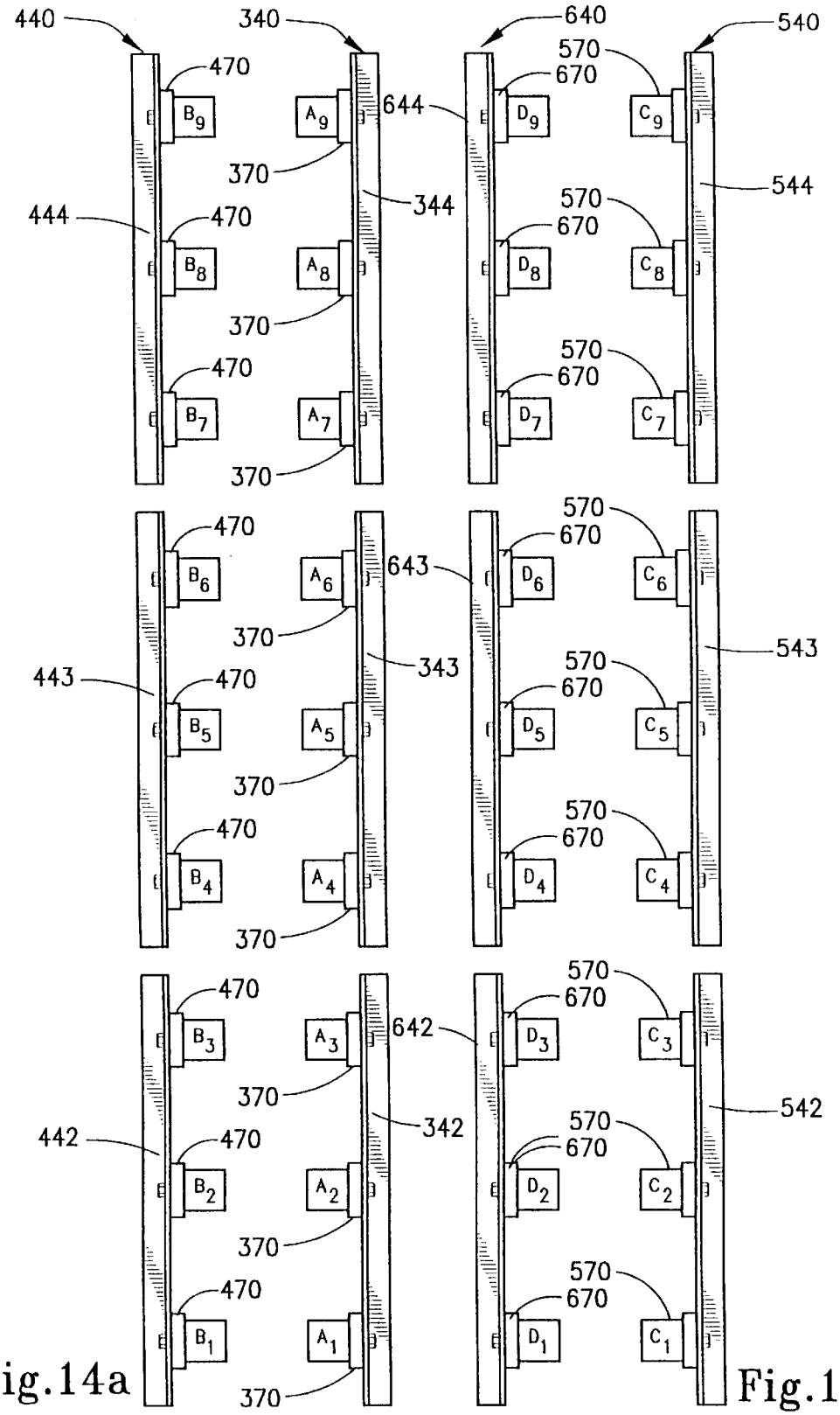

11(*b*) is a perspective view of an alternative embodiment of the carriage mount according to the present invention;

FIG. 12 is a perspective view of a representative carriage rail according to the present invention with a pair of limit stops thereon;

FIG. 13 is a top plan view of the carriage rail, carriage mount and tooling rail assembly according to the exemplary embodiment of the present invention; and FIGS. 14(*a*) and 14(*b*) show alternate rail structures for use with the material forming machine of FIGS. 1–13 of the present invention.

DETAILED DESCRIPTION OF THE EXEMPLARY EMBODIMENTS

The present invention is directed to material forming machines specifically adapted to bend one or both longitudinal margins of a flat strip of metal into a desired profile. While the present invention may be employed with elongated strips of material cut at discrete lengths, it is contemplated that the present invention may be primarily used with a continuous feed structure wherein formed strips having a desired longitudinal profile are cut out of continuous strip of material that fed into the forming machine. Specifically, the present invention is constructed to receive a variety of different sets of metal forming stations mounted as sets on rail structures so that the different sets may be easily interchanged to allow fabrication of different panel profiles. In addition, it is a particular feature of the present invention to provide improved structure for lateral adjustment of the different sets of forming stations so that the profile dimensions can be easily and precisely altered thereby to minimize the down time of the machine. To this end, it should be understood that the phrase "panel" when used in the context of a formed strip can include, for example, a standing seam panel, siding, guttering, structural or nonstructural framing members and the like, as would be understood by the ordinarily skilled person in the material forming art. Moreover, while the present machine is specifically adapted to form metal panels, it should be understood that it is within the context of this invention to form profiles of other types and on other types of formable materials.

Figure 1:
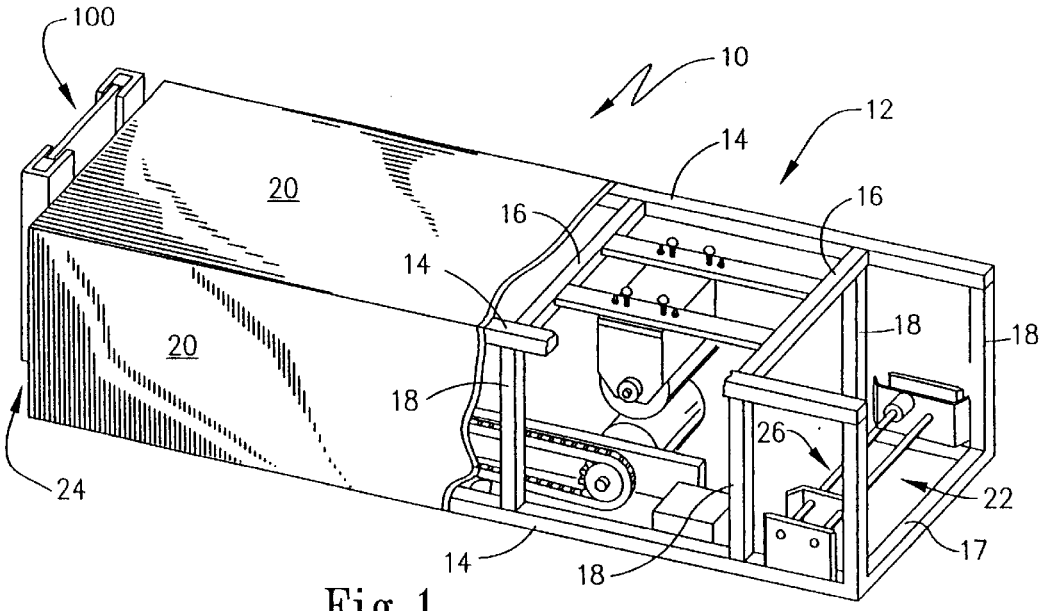
FIG. 1 is a perspective view, partially cut-away, of a forming machine according to the exemplary embodiment of the present invention.
Figure 2:
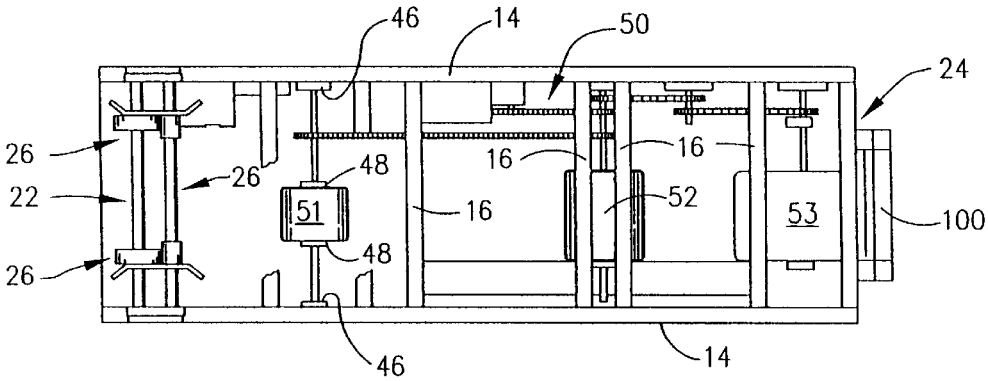
FIG. 2 is a top plan view of the forming apparatus of FIG. 1 with the outer panel coverings removed therefrom.

By way of explanation, then, a representative material forming apparatus 10 is introduced in FIGS. 1 and 2. Here, forming apparatus 10 is constructed as a machine that may, for example, be used to fabricate roof panels, siding panels, gutters and the like. Forming apparatus 10 includes a framework 12 formed as a plurality of longitudinally extending beams 14 interconnected by means of upper transverse beams 16, lower transverse beams 17 and upright beams 18. Frame 12 is encased by an outer panel covering 20 which extends therearound. Forming apparatus 10 has an entryway 22 located at a first end and an exit 24 located at a second end which is in a longitudinally positioned at a downstream location from the first end of frame 12. A shear 100 may be located at exit 24 to cut selected lengths of formed materials, as is known in the art.

Forming apparatus 10 is particularly adapted to receive an elongate flat sheet of formable material, such as metal, and to shape the sheet of material 27 into a shaped member which may be used, for instance, in the construction industry. In particular, forming apparatus 10 is adapted to form roof panels or siding panels wherein mating profiles are formed on the opposite edge margins of the sheet of material so that, after the panels are formed, adjacent panels may interlocked together as is known in the art. To this end, the elongated sheet 27 enters the forming apparatus 10 at an upstream location defined by entrance 22 and initially comes in contact with a guide assembly 26 described more thoroughly below in reference to FIG. 5.

Figure 3:
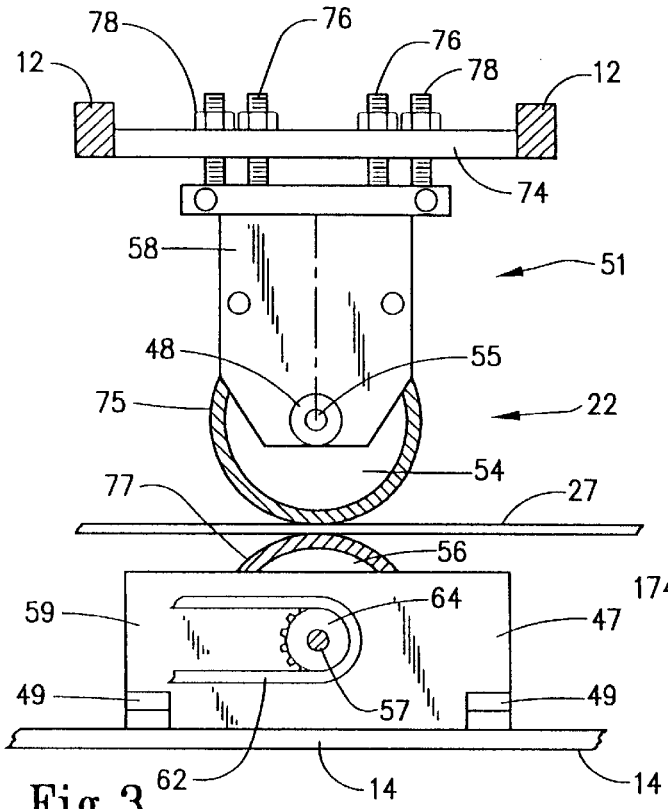
Fig.3 (PRIOR ART)
FIG. 3 is a side view in elevation and in partial cross-section showing a representative construction of the co-acting pair of rollers (one drive and one free wheeling) according to the exemplary embodiment of the present invention.
Figure 4:
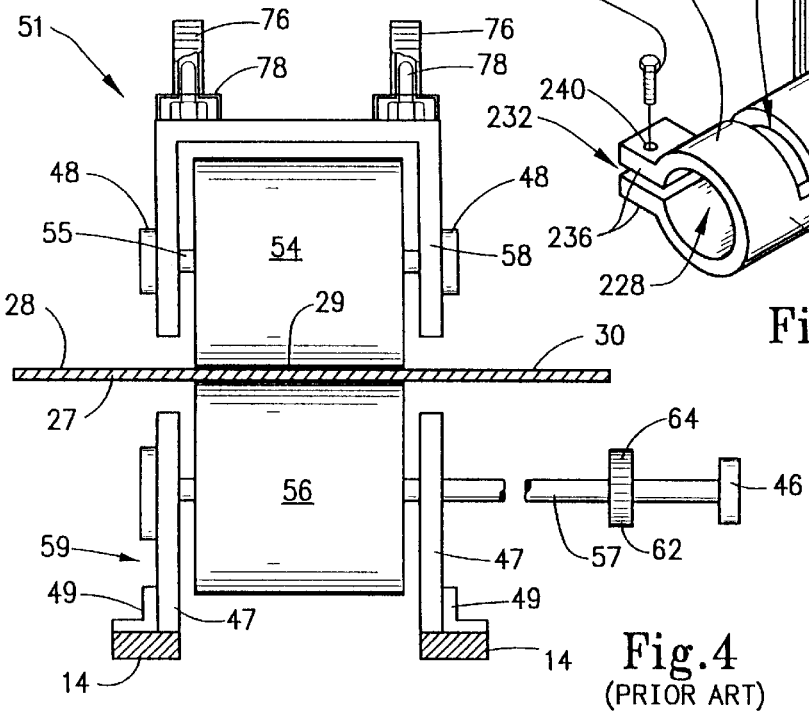
Fig.4 (PRIOR ART)
FIG. 4 is an end view in elevation, looking upstream of a first representative pair of co-acting rollers of FIG. 3 and showing the elongated strip of material passing therethrough.
Figure 5:
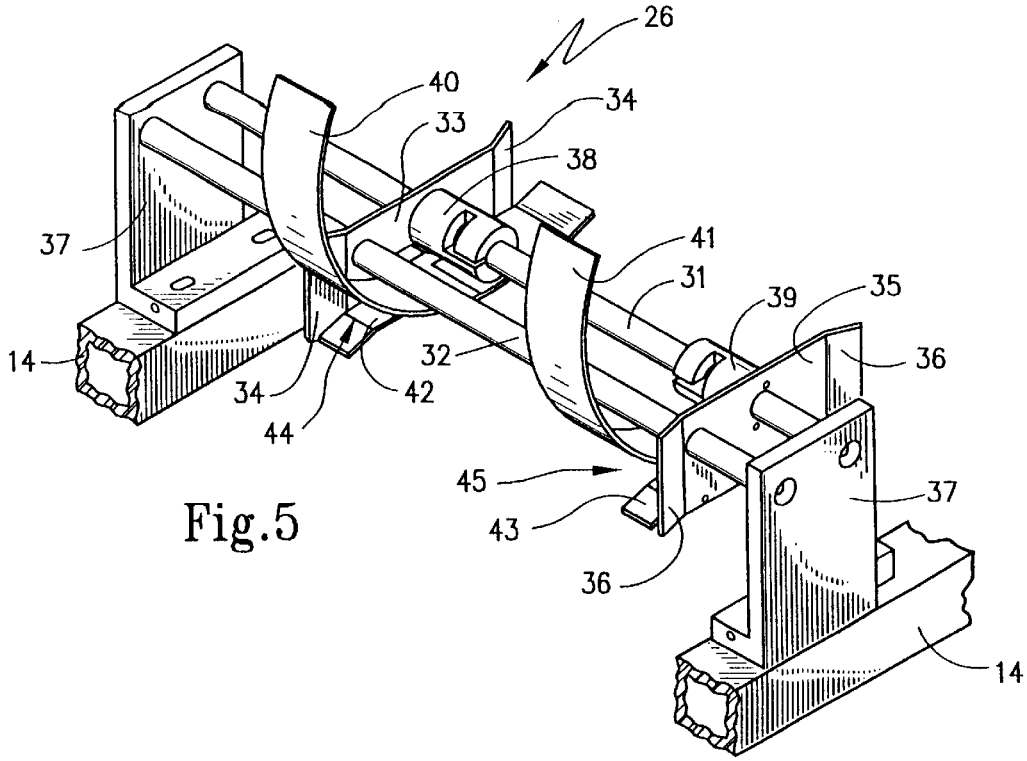
FIG. 5 is a perspective view of the entryway guide of the present invention.

With reference to FIG. 2, it may be seen in that forming apparatus 10 includes a drive assembly 50 that will be described in greater detail below with reference to FIG. 6. Drive assembly 50 includes a plurality of drive stations 51, 52 and 53 which are each located at longitudinally spaced-apart downstream regions from each other within framework 12. Drive stations 5153 are mechanically coupled to one another and powered by a chain assembly best shown in FIG. 6. The preferred construction for a representative drive station 51 is shown with reference to FIGS. 3 and 4. However, it should be appreciated by one skilled in the art that drive station 52 would be constructed similarly. A representation example of these drive stations is shown in FIG. 4 wherein drive station 51 includes a pair of co-acting rollers 54 and 56 each respectfully journaled for rotation around first axle 55 and second axle 57. First axle 55 and second axle 57 define axes for rollers 54 and 56 that are oriented transversely to the downstream direction in which the sheet of material is advanced and are parallel to that sheet as it passes through forming apparatus 10. Axles 55 and 57 are each mounted to frame 12 by means of bearing blocks 46 and 48, as is shown in FIG. 2.

Drive stations 51–53 are constructed substantially in U.S. Pat. No. 5,740,687, the disclosure and teachings of which are specifically incorporated herein by reference especially that in FIGS. 1–4 and 6. In FIGS. 3 and 4, it may be seen that upper roller 54 is a free-wheeling roller, while lower roller 56 is a driven roller. Preferably each of these rollers is covered by a circumferential layer of polyurethane, 75 and 77, as is shown in FIG. 3. Free wheeling roller 54 and driven roller 56 co-act with one another to grip a central portion 29 of sheet 27 as it is advanced in the downstream direction.

Both free wheeling roller 54 and driven roller 56 are disposed in housings 58 and 59, respectively. Housing 59 for driven roller 56 is stationary relative to frame 12, and it includes plates 47 secured to angle bars 49 mounted to longitudinal rails 14. Housing 58 for free wheeling roller 54 is adjustably mounted to frame 12 by screws 76 and jack-screws 78 which permit vertical adjustment of the free wheeling roller 54 relative to driven roller 56. It should be understood, then, that as sheet 27 is advanced from the upstream region proximate entrance 22, its lateral margins 28 and 30 will be subjected to the forming stations, as discussed below. Central portion 32 of sheet 27 is sandwiched between free wheeling roller 54 and driven roller 56.

In order to introduce sheet 27 into the first driven station 51, guide assembly 26 is provided at entryway 22. Guide assembly 26 is seen best in FIG. 5 where it may be seen that a pair of brackets 37 are mounted longitudinal beams 14 and support a pair of spaced-apart parallel round bars 31 and 32. A first guide plate 33 is slideably disposed on bars 31 and 32 and is secured to a cylindrical clamp 38 that is slideably received on bar 31. Guide plate 33 has a pair of oppositely projecting wings 34. Similarly, a second guide plate 35 is slideably disposed on bars 31 and 32 and is fastened to a cylindrical clamping piece 39. An upwardly arcuate strap 40 is secured to guide plate 33 and an upwardly arcuate strap 41 is secured to guide plate 35. A smaller strap 42 is secured to guide plate 33 and, together with strap 40, forms a converging region 44 into which a leading edge of sheet 27 may be inserted. Likewise, a smaller strap 43 is mounted on plate 35 and, together with arcuate strap 41, forms a converging region 45 for the leading edge of sheet 22. Each of clamps 38 and 39 may be released for lateral adjustment of each of plates 33 and 35 and, when secured, act to retain plates 33 and 35 in the desired orientation. Preferably, this orientation is the width of the sheet 27 that is to be processed by forming apparatus 10.

Figure 6:
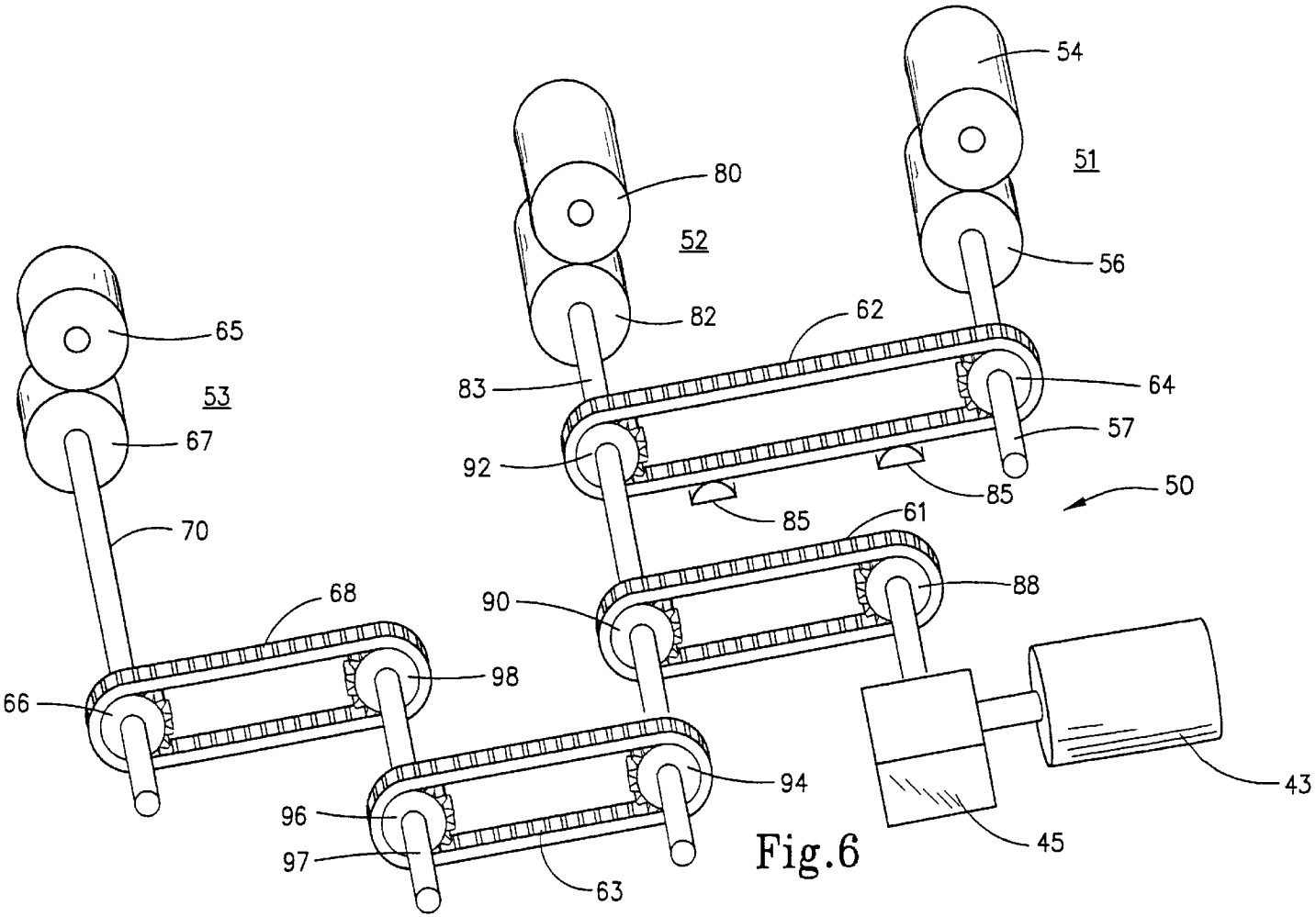
FIG. 6 is a perspective view of the drive system, driven rollers and free wheeling rollers according to the exemplary embodiment of the present invention.

FIG. 6 shows the construction and operation of the drive assembly 50 according to the exemplary embodiment of the present invention. Here it may be seen that drive assembly 50 is empowered by a driver in the form of a motor 43 which is connected to gear box 45 to provide rotary power to each of the drive stations 51–53. Motor 43 drives sprocket wheels 88 and 90, which are coupled together by chain 61, in a counterclockwise direction as sown in FIG. 6. Sprocket gear 90 is disposed about second axle 83 of driven roller 82 and, thereby, causes sprocket wheels 92 and 94 to also rotate in a counterclockwise direction. Sprocket wheel 92 is coupled by a second chain 62 to sprocket wheel 64 which is disposed about second axle 57 of driven roller 56. Located beneath a lower portion of chain 62 between sprocket wheels 92 and 64 are a pair of polyurethane chain tighteners 84 and 85.

It should be understood that the counterclockwise rotation of sprocket wheel 92 causes sprocket wheel 64 to also rotate in a counterclockwise direction, thereby permitting rotation of driven roller 56. Driven roller 56 is thus rotatably driven in a counterclockwise direction; the counterclockwise rotation of driven roller 56 imparts a clockwise rotation of free wheeling roller 54 about first axis 55 to advance sheet 27 downstream. Likewise, driven roller 67 of driven station 53 rotates in the counterclockwise direction by virtue of its mechanical coupling to sprocket wheel 94. To illustrate, as sprocket 94 rotates counterclockwise, it causes sprocket wheel 96 to rotate by virtue of its mechanical coupling thereto by chain 63. A similar counterclockwise rotation is imparted to sprocket wheel 98 which is adjoined to sprocket wheel 96 by axle 97. As sprocket wheel 98 rotates counterclockwise, the second axle 70 of driven roller 67 in drive station 53 is also caused to rotate in the same manner. Moreover, free wheeling roller 65 rotates in the clockwise direction. From the foregoing, it should be understood by one of ordinary skill that the chain coupling discussed above enables each of the co-acting pairs of roller in drive stations 51–53 to cooperate in unison with one another.

With reference now to FIGS. 7–10, the structure of the carriage rail, carriage mount and tooling rail assembly used with the exemplary embodiment of the present invention is shown. In these Figures, assembly 110 is shown to include a pair of rail mounts 112 and 114 which are in parallel spaced-apart relation to one another so that they may be mounted alongside longitudinal beams 14 at a lower portion of framework 12. Rail mounts 112 and 114 are the primary mounts for assembly 110 and are supported by lower pairs of transverse members in the form of lower beams 17. To this end, primary rail mount 112 has oppositely projecting arms 113 adapted to rest on a pair of lower beams 17. Likewise, rail mount 114 has a pair of oppositely projecting arms 115 also adapted to rest on a pair of lower beams 17. A pair of carriage rails 116 and 118 extend between opposite ends of rail mounts 112 and 114 so as to be in parallel spaced-apart relation to one another. Thus, carriage rails 116 and 118 extend transversely of framework 12 and the direction of advancement of material through forming apparatus 10.

A first carriage mount 120 and a second carriage mount 122 are slideably disposed on each of carriage rails 116 and 118. The structure of carriage mounts 120 and 122 are described more thoroughly below. A first pair carriage mounts 120 supports an intermediate tooling rail mount 124 which is in the form of an elongated rectangular bar of sufficient length to extend longitudinally between and preferably beyond carriage mounts 120 in both the upstream and downstream direction. A tooling rail 126 is then secured by means of bolts or other fasteners, to tooling rail 126 to form a rigid structure that will slide in the direction of arrow "A" (FIG. 8) on slide mounts 120. Similarly, an intermediate tooling rail mount 128 extends in the longitudinal direction between a pair of carriage mounts 122. Intermediate tooling rail mount 128 is structured similarly as intermediate tool rail mount 124. Here again, tooling rail mount 128 supports a tooling rail 130 with tooling rail 130 also extending in the longitudinal direction. Thus, tooling rail 130 may be moved laterally in the direction of arrow "B" (FIG. 8).

Figure 7:
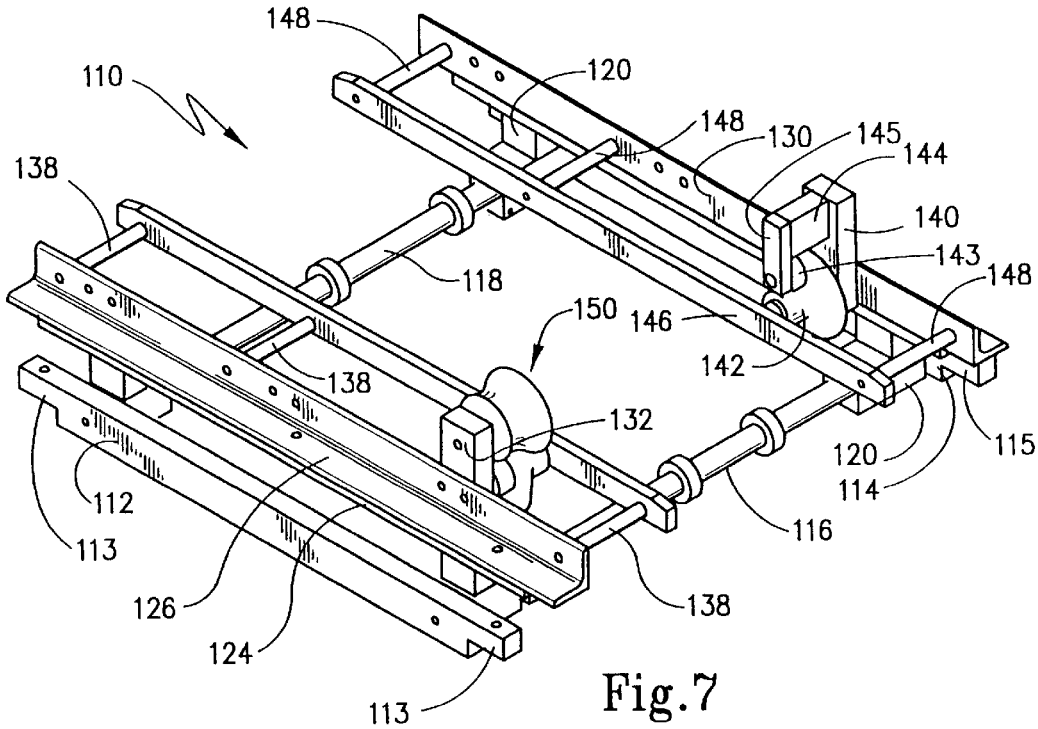
FIG. 7 is a perspective view of a carriage rail, carriage mount and tooling rail assembly used with the exemplary embodiment of the present invention showing a pair of opposed forming stations mounted thereon.
Figure 8:
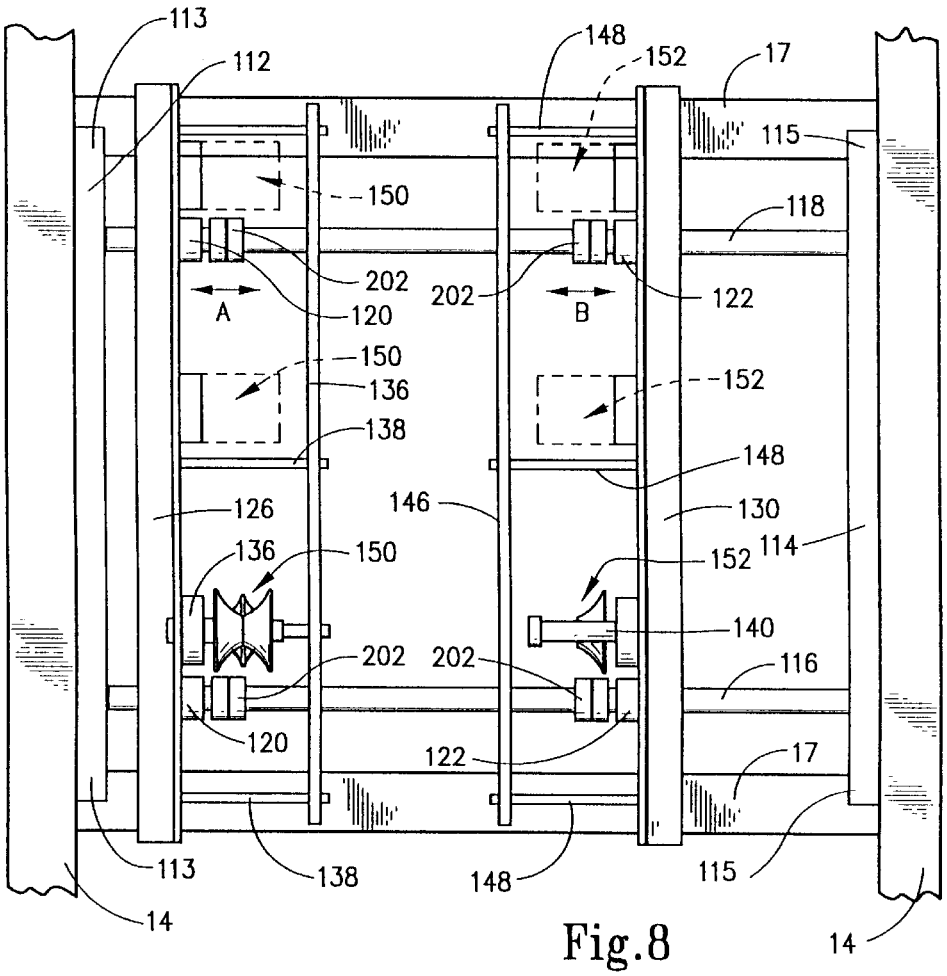
FIG. 8 is a top view in elevation showing the carriage rail, carriage mount and tooling rail assembly of FIG. 6 mounted in the framework of the machine and adjusted to a representative orientation for forming profiles on the edge margins of an elongated margin sheet of material passing therethrough.

As is shown in FIGS. 7 and 8, tooling rail 124 supports at least one but preferably a plurality of forming stations 150. To this end, an upright mounting block 132 rotatably supports, for example, a pair of forming rollers 134 and 135 on axles, as is known in the art. To give further support to mounting stations 150, a guide bar 136 is provided and is supported on inwardly projecting posts 138 so that guide bar 136 is parallel to tooling rail 126. Similarly, tooling rail 130 supports a plurality of forming stations 152 on mounting blocks 140. Forming station 152 is formed by a pair of forming rollers 142 and 143 which are rotatably mounted on respective axles. Positioning blocks 144 and 145 are provided to position forming roller 143. A second guide bar 146 is associated with rail 130 and is mounted in parallel spaced-apart relation thereto by means of posts 148. Guide bars 136 and 146 act to strengthen the support of the forming stations 150 and 152, for example, by supporting an end of the axle for forming rollers 135 and 142 that is opposite the respective mounting block 132 and 140. Guide bars 136 and 146 also act to support the sheet-like material as it is advanced through forming apparatus 10. As is shown in FIG. 8, in phantom, a plurality of forming stations 150 may be provided on rail 126 and, likewise, a plurality of forming stations 152 may be supported by tooling rail 130.

Figure 10:
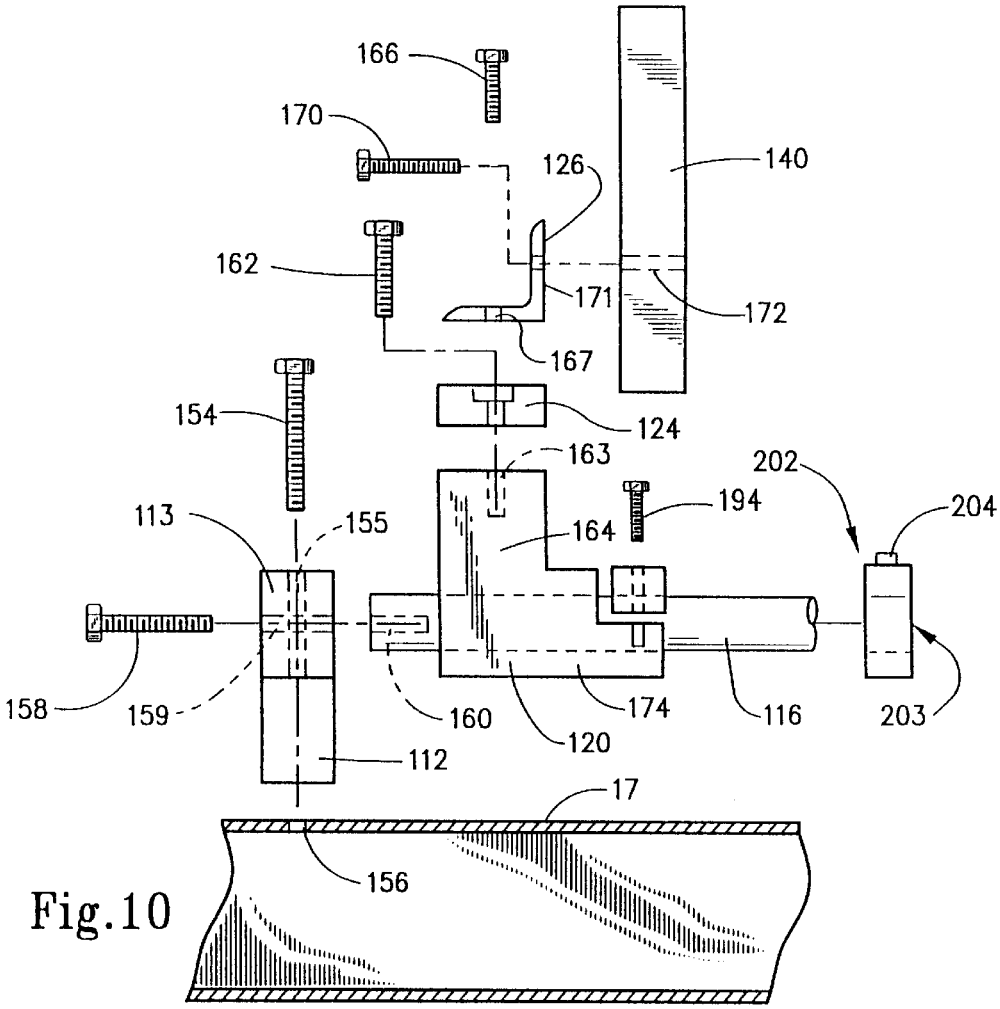
FIG. 10 is an exploded end view in elevation and in partial cross-section showing the assembly of the carriage rail, carriage mount and tooling rail structure according to the present invention.

In order to more fully understand the construction just described, an exploded view of a representative rail mount, carriage rail and tooling rail assembly is shown in FIG. 10. Here, it may be seen that rail mount 112 may be mounted to lower beams 17 by means of a bolt 154 extending through bore 155 in arm 113 and mated with threaded opening 156 in beam 17. Carriage rail 116 is then secured to rail mount 112 by means of a bolt 158 extending through bore 159 and received in threaded bore 160 of the end of carriage 116. Prior to the attachment of carriage 116, carriage mounts 120 and 122 are slideably positioned thereon.

Intermediate tool rail mount 124 is fastened to carriage mount 120 by means of a bolt 162 extending through a bore in intermediate rail mount 124 and received by threaded bore 163 in a head portion 164 of carriage mount 120. Tooling rail 126 is then mounted by means of bolt 166 extending through bore 167 and threadably received in intermediate tooling rail mount 124. Mounting block 140 is then secured to tooling rail 126 by means of bolt 170 extending through bore 171 and received in bore 172 of mounting block 140. Here, it may be appreciated that bolt 170 may be suitably dimensioned to engage an end of the axle of forming station 150.

Figure 11A:
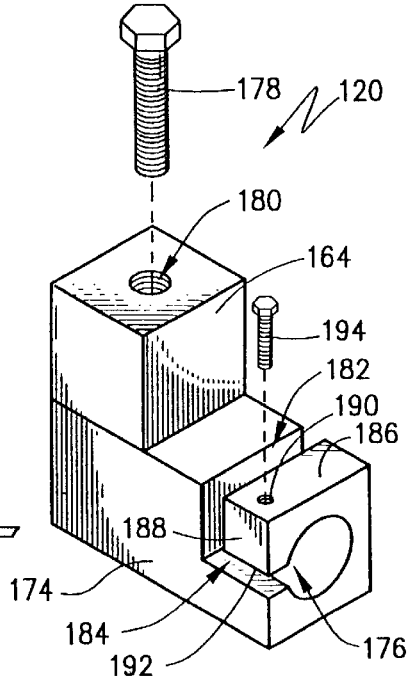
FIG. 11(*a*) is a perspective view of a first embodiment of a carriage mount according to the present invention and FIG.
Figure 11B:
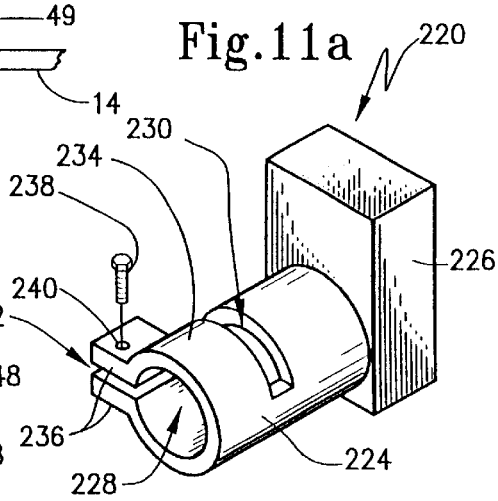

The structure of carriage mount 120 (and corresponding carriage mount 122) is best shown in FIG. 11(*a*). As is seen in this Figure, carriage mount 120 includes a body portion 174 which has a longitudinally extending bore 176 extending through the length thereof. Head portion 164 may be formed integrally with body portion 174 but, as is shown in FIG. 11(*a*), may be an independent piece that is bolted to body portion 174 by means of bolt 178. If desired, bolt 178 may be countersunk in recess 180. Alternatively, bolt 178 may be dimensioned so that it fastens intermediate tool rail mount 124, head 164 and body portion 174 together. In any event, a transverse slot 182 is cut in body portion 174 and intersects bore 176. A second slot 184 is cut longitudinally in body portion 174 and intersects both slot 182 and bore 176. In this manner, a clamp arm 186 is configured and provides a means for securing carriage mount 120 at a selected location along its carriage rail 16. To this end, the free end 188 of clamp arm 186 has a bore 190 extending vertically therethrough and aligned with threaded bore 192. A screw 194 may then be inserted through bore 190 and threadably received in bore 192. When tightened, screw 194 operates to reduce the diameter of bore 176 in a region adjacent clamp arm 186 so that carriage mount 120 may be selectively positioned and retained on a respective carriage rail.

An alternative construction of the carriage mount 120 is shown in FIG. 11(*b*). Here, carriage mount 220 includes a body portion 224 and an end block 226 that is secured thereto. Body portion 124 is cylindrical and has a cylindrical bore 228 extending therethrough. A transverse slot 230 is cut to intersect bore 228, and a longitudinal slot 232 intersects both bore 228 and slot 230 in a manner similar to that described above. In this manner, clamp arm 234 is formed similarly to clamp arm 186. Here, however, a pair of flanges 236 may be provided and project radially outwardly of slot 232 at arm 234 and may be secured together by means of screw 238 extending in hole 240. It should be understood that the operation of the carriage mount 220 is the same as carriage mount 120.

Figure 9:
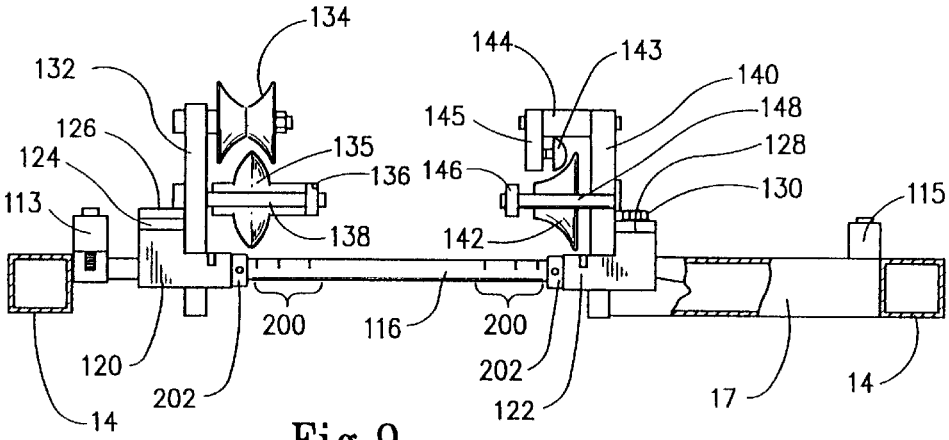
FIG. 9 is an end view in elevation showing the carriage rail, carriage mounts and tooling rail assembly and frame of FIG. 7.

With reference now to FIGS. 8, 9 and 12, it may be seen that a representative carriage rail 116 (as well as carriage rails 118) may be provided with index markings 200 to help facilitate lateral adjustment of carriage mounts 120 to a desired lateral position. Thus, the tooling rails and the tooling stations may be laterally moved within framework 12 to accommodate different widths of sheet material or to alter the dimensions of the selected profile that will be formed by forming stations 150 and 152. Once in position, clamping arm 186 of each mounting block 120 is secured by tightening its respective screw 194 so that carriage mount 120 is properly positioned and virtually retained on its respective carriage rail. To further facilitate this, a limit stop in the form of a locking collar 202 has a bore 203 sized so that each locking collar 202 may be slideably received on a carriage rail 116, 118. Locking collar 202 is provided with a locking set screw 204 so that, when locking collar 202 is positioned, set screw 204 may be tightened to lock collar 202 at the selected position. Locking collar 202 may be released by loosening screw 204 and repositioning the locking collar in the directions of arrows "C" (FIG. 12). In addition to providing further support for carriage mounts 120, locking collars 202 may be set at a desired location so that they provide limit stops for quick adjustment of the carriage mounts. For example, when the carriage mounts are positioned in a first selected location for the dimensions of the profile to be formed, locking collars 202 may be preset at a second desired location. Then, when the user desires to change the profile dimensions, he/she simply loosens screws 194 and slides the mounting blocks against the respective locking collars 202.

With reference now to FIG. 13, it may be seen that framework 12 provides a plurality of pairs of carriage rails 116 and 118 each with carriage mounts 120, 122. A pair of longitudinally extending tooling rail mounts 124 and 128 are mounted on framework 12. Here, an intermediate tooling rail mount 124 extends between a pair of carriage mounts 120 on a respective pair of carriage rails 116, 118. Likewise, a second intermediate tooling rail mount 128 extends between a pair of carriage mounts 122 on a respective pair of carriage rails 116, 118.

With FIG. 13 in mind, and with reference to FIGS. 14(*a*) and 14(*b*), it should now be appreciated that tooling rails 126 and 130 with their associated forming stations 150 and 152 may be mounted as sets. Tooling rails 126 mounts form one lateral rail structure for forming one margin of the sheet of material while tooling rails 130 form a second rail structure that carries forming stations 152 to configure a second lateral margin of the sheet to be formed. This is similar to that disclosed in U.S. Pat. No. 5,425,259 which is incorporated herein by reference, particularly FIGS. 12(*a*) and 12(*b*) and the related text. It should be appreciated that each rail structure carries a plurality of forming stations mounted thereon and that alternative rail structures may be interchanged to provide different forming stations whereby different edge profiles may be fabricated. For example, as is shown in FIG. 14(*a*), a first rail structure 340 includes a first rail section 342, a second rail section 343 and a third rail section 344 which may be longitudinally aligned with one another. Rail section 342 carries forming stations A1–A3 on respective mounting blocks 370 while rail section 343 carries forming stations A4–A6 on mounting blocks 370. Rail section 344 carries forming stations A7–A9 on mounting blocks 370. Removal of rail sections 342, 343 and 344 would allow removal of all of forming stations A1–A9 without removing the forming stations from the respective rail section. Similarly, second rail structure 440, shown in FIG. 14(*a*), is formed of three rail sections 442, 443 and 444. Rail section 442 carries forming stations B1–B3 respectively mounted on plates 470 while rail section 443 carries a plurality of forming stations B4–B6 on mounting plates 470. Rail section 444 carries forming stations B7–B9 on plates 470. Again, removal of each of rail sections 442, 443 and 444 allows removal of all of forming stations B1–B9 from the forming region. Likewise in FIG. 14(*b*), first rail structure 540 has aligned rail sections 542, 543 and 544 which respectively mount forming stations C1–C3, C4–C6 and C7–C9; second rail structure 640 has aligned rail sections 642, 643 and 644 which mount forming stations D1–D3, D3–D6 and D7–D9, respectively, on plates 570 and 670.

It should now be appreciated with the structure described above, alternative sets of forming elements may be removed from the forming machine 10 without detaching the respective pairs of forming elements that define the forming stations from the respective rails. Therefore, a fabricator may fabricate different profiles by using different sets of first and second rail structures without the need to use a different forming machine. That is, the various forming elements that define the forming stations may be inserted and removed from the machine as easily mounted sets without removing those forming elements from their respective rails. Since the attachment of each rail is accomplished by simply bolting the rail to its respective intermediate tooling rail mount, very little time is necessary to complete this process.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

We claim:

1. A forming machine adapted to receive an elongated sheet of formable material and operative to form a desired profile thereon, comprising:

(a) a rigid framework including side frames rigidly interconnected to one another by transverse members to form a rigid cage having an interior and a width between said side frames, said cage extending about a forming region through which the elongated sheet may be advanced in a longitudinal direction from an upstream entrance to a downstream exit;

(b) a sheet drive supported by said framework and operative to advance the elongated sheet therethrough, said sheet drive including a plurality of pairs of co-acting rollers, each of said pairs being longitudinally spaced from an adjacent one of said pairs in a downstream direction from the entrance to the exit;

(c) a drive assembly interconnected to at least one roller in each of said pairs or co-acting rollers and operative to rotatably drive said one roller whereby each of said pairs of co-acting rollers is operative to engage a portion of the elongated sheet and advance the elongated sheet in a downstream direction through said framework to discharge the elongated sheet at the exit;

(d) a plurality of pairs of carriage rails supported by said framework with said pairs each located in a plane that is substantially parallel to the longitudinal direction, each of said carriage rails extending transversely of said framework and having opposite ends secured to said framework at a location proximately to a respective side frame so as to extend a majority of the width of said framework;

(e) first and second carriage mounts slideably disposed on each of said carriage rails;

(f) a longitudinally extending first tooling rail secured in a mounted state to the first carriage mounts on each said pair of carriage rails and a longitudinally extending second tooling rail secured in a mounted state to the second carriage mounts on each said pair of carriage rails whereby said tooling rails may be moved laterally within said cage; and (g) a plurality of forming elements supported by each said tooling rail to define at least two forming stations located in a longitudinally spaced relation to one another along said tooling rail, said forming stations positioned to receive an edge portion of the elongated sheet when in the mounted state whereby said forming stations are operative to bend the elongated sheet into the desired profile as the elongated sheet is advanced through the forming region by said drive assembly.

2. A forming machine according to claim 1 including upper ones of said transverse members and lower ones of said transverse members.

3. A forming machine according to claim 2 wherein each of said pairs of co-acting rollers includes a driven roller and a free-wheeling roller.

4. A forming machine according to claim 3 wherein each said free-wheeling roller is rotatably supported by upper ones of said transverse members and wherein rotation of one of said driven rollers imparts an equal counter-rotation of its associated free-wheeling roller.

5. A forming machine according to claim 1 wherein each of said pairs of co-acting rollers includes a driven roller and a free-wheeling roller.

6. A forming machine according to claim 1 including a plurality of pairs of opposed primary rail mounts secured to said framework in parallel spaced-apart relation to one another, one primary rail mount of each pair extending alongside one of said side frames and another primary rail mount of each pair extending alongside another one of said side frames.

7. A forming machine according to claim 6 including lower pairs of said transverse members disposed in parallel spaced-apart relation to one another, the primary rail mounts of each of said pairs of opposed primary rail mounts extending longitudinally between respective ones of said lower pairs of said transverse members.

8. A forming machine according to claim 6 including a first intermediate tooling rail mount secured in an affixed state between the first carriage mounts on each said pair of carriage rails and a second intermediate tooling rail mount secured in an affixed state between the second carriage mounts on each said pair of carriage rails.

9. A forming machine according to claim 8 wherein each said tooling rail is removably secured to a respective intermediate tooling rail mount.

10. A forming machine according to claim 1 wherein said tooling rails are movable laterally and independently of one another in the interior of said cage.

11. A forming machine according to claim 1 wherein said carriage rails have markings thereon to correspond to selected positions for said carriage mounts.

12. A forming machine according to claim 1 including at least one movable limit stop member disposed on each carriage rail, each said limit stop member adjustably positionable along its respective carriage rail and operative when in a secured state to restrict movement of a respective carriage mounts in at least one lateral direction.

13. A forming machine adapted to receive an elongated sheet of formable material and operative to form a desired profile thereon, comprising:

(a) a rigid framework including side frames rigidly interconnected to one another by transverse members to form a rigid cage having an interior and a width between said side frames, said cage extending about a forming region through which the elongated sheet may be advanced from an upstream entrance to a downstream exit, said framework including lower pairs of said transverse members disposed in parallel spaced-apart relation to one another in a horizontal plane;

(b) a sheet drive supported by said framework and operative to advance the elongated sheet therethrough, said sheet drive including a plurality of pairs of co-acting rollers wherein one of said co-acting rollers is a driven roller and another of said co-acting rollers is a free-wheeling roller, each of said pairs being longitudinally spaced from an adjacent one of said pairs in a downstream direction from the entrance to the exit;

(c) a drive assembly interconnected to at least one roller in each of said pairs of co-acting rollers and operative to rotatably drive said one roller whereby each of said pairs of co-acting rollers is operative to engage a portion of the elongated sheet and advance the elongated sheet in a downstream direction through said framework to discharge the elongated sheet at the exit;

(d) a plurality of pairs of opposed primary rail mounts secured to said framework in parallel spaced-apart relation to one another, one primary rail mount of each pair extending alongside one of said side frames and another primary rail mount of each pair extending alongside another one of said side frames, said primary rail mounts of each of said pairs of opposed primary rail mounts extending longitudinally between and supported by respective ones of said lower pairs of said transverse members;

(e) a plurality of pairs of carriage rails supported by respective ones of said primary rail mounts and extending transversely of said framework;

(f) first and second carriage mounts slideably disposed on each of said carriage rails;

(g) a first tooling rail secured in a mounted state to the first carriage mounts on each said pair of carriage rails and a second tooling rail secured in a mounted state to the second carriage mounts on each said pair of carriage rails whereby said tooling rails may be moved laterally and independently of one another in the interior of said cage; and (h) a plurality of forming elements supported by each said tooling rail to define at least two forming stations located in a longitudinally spaced relation to one another along said tooling rail, said forming stations positioned to receive an edge portion of the elongated sheet when in the mounted state whereby said forming stations are operative to bend the elongated sheet into the desired profile as the elongated sheet is advanced through the forming region by said drive assembly.

14. A forming machine according to claim 13 wherein each said free-wheeling roller is rotatably supported by upper ones of said transverse members and wherein rotation of one of said driven rollers imparts an equal counter-rotation of its associated free-wheeling roller.

15. A forming machine according to claim 13 including a first intermediate tooling rail mount secured in an affixed state between the first carriage mounts on each said pair of carriage rails and a second intermediate tooling rail mount secured in an affixed state between the second carriage mounts on each said pair of carriage rails, and wherein each said tooling rail is secured to a respective intermediate tooling rail mount.

16. A forming machine according to claim 13 wherein said carriage mounts each include a body portion having a bore extending therethrough and a mounting head, said body portion including slots formed therein that intersect the bore thereby to form a clamping arm operative to extend around a respective carriage rail, said clamping arm having an associated fastener operative to selectively clamp its respective said carriage mount at a selected location along said carriage rail.

17. A forming machine adapted to receive an elongated sheet of formable material and operative to form a desired profile thereon, comprising:

(a) a rigid framework including generally vertical side frames rigidly interconnected to one another by transverse members to form a rigid cage having an interior and a width between said side frames, said cage extending about a forming region through which the elongated sheet may be advanced in a longitudinal direction from an upstream entrance to a downstream exit;

(b) a sheet drive supported by said framework and operative to advance the elongated sheet therethrough, said sheet drive including a plurality of pairs of co-acting rollers, each of said pairs being longitudinally spaced from an adjacent one of said pairs in a downstream direction from the entrance to the exit;

(c) a drive assembly interconnected to at least one roller in each of said pairs or co-acting rollers and operative to rotatably drive said one roller whereby each of said pairs of co-acting rollers is operative to engage a portion of the elongated sheet and advance the elongated sheet in a downstream direction through said framework to discharge the elongated sheet at the exit;

(d) a plurality of pairs of carriage rails supported by said framework and extending transversely thereof with each pair of carriage rails organized in a generally horizontal plane, each of said carriage rails having opposite ends secured to said framework at a location proximately to a respective side frame so as to extend a majority of the width of said framework;

(e) first and second carriage mounts slideably disposed on each of said carriage rails;

(f) a longitudinally extending first tooling rail secured in a mounted state to the first carriage mounts on each said pair of carriage rails and a longitudinally extending second tooling rail secured in a mounted state to the second carriage mounts on each said pair of carriage rails whereby said tooling rails may be moved laterally within said cage; and (g) a plurality of forming elements supported by each said tooling rail to define at least two forming stations located in a longitudinally spaced relation to one another along said tooling rail, said forming stations positioned to receive an edge portion of the elongated sheet when in the mounted state whereby said forming stations are operative to bend the elongated sheet into the desired profile as the elongated sheet is advanced through the forming region by said drive assembly.

18. A forming machine according to claim 17 wherein each of said pairs of co-acting rollers includes a driven roller and a free-wheeling roller.

19. A forming machine according to claim 17 including a plurality of pairs of opposed primary rail mounts secured to said framework in parallel spaced-apart relation to one another, one primary rail mount of each pair extending alongside one of said side frames and another primary rail mount of each pair extending alongside another one of said side frames.

20. A forming machine according to claim 19 including lower pairs of said transverse members disposed in parallel spaced-apart relation to one another, the primary rail mounts of each of said pairs of opposed primary rail mounts extending longitudinally between respective ones of said lower pairs of said transverse members.

21. A forming machine adapted to receive an elongated sheet of formable material and operative to form a desired profile thereon, comprising:

(a) a rigid framework including side frames rigidly interconnected to one another by transverse members to form a rigid cage having an interior and a width between said side frames, said cage extending about a forming region through which the elongated sheet may be advanced from an upstream entrance to a downstream exit;

(b) a sheet drive supported by said framework and operative to advance the elongated sheet therethrough, said sheet drive including a plurality of pairs of co-acting rollers, each of said pairs being longitudinally spaced from an adjacent one of said pairs in a downstream direction from the entrance to the exit;

(c) a drive assembly interconnected to at least one roller in each of said pairs or co-acting rollers and operative to rotatably drive said one roller whereby each of said pairs of co-acting rollers is operative to engage a portion of the elongated sheet and advance the elongated sheet in a downstream direction through said framework to discharge the elongated sheet at the exit;

(d) a plurality of pairs of carriage rails supported by said framework and extending transversely thereof, each of said carriage rails having opposite ends secured to said framework at a location proximately to a respective side frame so as to extend a majority of the width of said framework;

(e) first and second carriage mounts slideably disposed on each of said carriage rails, said carriage mounts each including a body portion having a bore extending therethrough and a mounting head, said body portion including slots formed therein that intersect the bore thereby to form a clamping arm operative to extend around a respective carriage rail, said clamping arm having an associated fastener operative to selectively clamp its respective said carriage mount at a selected location along said carriage rail;

(f) a first tooling rail secured in a mounted state to the first carriage mounts on each said pair of carriage rails and a second tooling rail secured in a mounted state to the second carriage mounts on each said pair of carriage rails whereby said tooling rails may be moved laterally within said cage; and (g) a plurality of forming elements supported by each said tooling rail to define at least two forming stations located in a longitudinally spaced relation to one another along said tooling rail, said forming stations positioned to receive an edge portion of the elongated sheet when in the mounted state whereby said forming stations are operative to bend the elongated sheet into the desired profile as the elongated sheet is advanced through the forming region by said drive assembly.

22. A forming machine adapted to receive an elongated sheet of formable material and operative to form a desired profile thereon, comprising:

(a) a rigid framework including side frames rigidly interconnected to one another by transverse members to form a rigid cage having an interior and a width between said side frames, said cage extending about a forming region through which the elongated sheet may be advanced from an upstream entrance to a downstream exit;

(b) a sheet drive supported by said framework and operative to advance the elongated sheet therethrough, said sheet drive including a plurality of pairs of co-acting rollers, each of said pairs being longitudinally spaced from an adjacent one of said pairs in a downstream direction from the entrance to the exit;

(c) a drive assembly interconnected to at least one roller in each of said pairs of co-acting rollers and operative to rotatably drive said one roller whereby each of said pairs of co-acting rollers is operative to engage a portion of the elongated sheet and advance the elongated sheet in a downstream direction through said framework to discharge the elongated sheet at the exit;

(d) a plurality of pairs of carriage rails supported by said framework and extending transversely thereof, each of said carriage rails having opposite ends secured to said framework at a location proximately to a respective side frame so as to extend a majority of the width of said framework;

(e) first and second carriage mounts slideably disposed on each of said carriage rails, each said carriage mount including means for releasably securing it at a selected location along its respective carriage rail;

(f) a first tooling rail secured in a mounted state to the first carriage mounts on each said pair of carriage rails and a second tooling rail secured in a mounted state to the second carriage mounts on each said pair of carriage rails whereby said tooling rails associated with each pair of carriage rails may be moved laterally within said cage and independently of one another; and (g) a plurality of forming elements supported by each said tooling rail to define at least two forming stations located in a longitudinally spaced relation to one another along said tooling rail, said forming stations positioned to receive an edge portion of the elongated sheet when in the mounted state whereby said forming stations are operative to bend the elongated sheet into the desired profile as the elongated sheet is advanced through the forming region by said drive assembly.

* * * * *